US011361891B2

(12) United States Patent
Sato et al.

(10) Patent No.: US 11,361,891 B2
(45) Date of Patent: Jun. 14, 2022

(54) COIL COMPONENT

(71) Applicant: TAIYO YUDEN CO., LTD., Tokyo (JP)

(72) Inventors: Natsuko Sato, Tokyo (JP); Satoshi Tokunaga, Tokyo (JP); Satoshi Kobayashi, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 577 days.

(21) Appl. No.: 16/042,358

(22) Filed: Jul. 23, 2018

(65) Prior Publication Data

US 2019/0027288 A1 Jan. 24, 2019

(30) Foreign Application Priority Data

Jul. 24, 2017 (JP) ..... JP2017-142416

(51) Int. Cl.
*H01F 5/04* (2006.01)
*H01F 17/04* (2006.01)
(Continued)

(52) U.S. Cl.
CPC ..... *H01F 5/04* (2013.01); *H01F 17/04* (2013.01); *H01F 27/022* (2013.01);
(Continued)

(58) Field of Classification Search
CPC ..... H01F 5/04; H01F 17/04
See application file for complete search history.

(56) References Cited

U.S. PATENT DOCUMENTS

2004/0141297 A1* 7/2004 Tokuda ..... H01F 17/0013 361/762
2006/0152325 A1* 7/2006 Nakao ..... H01F 17/0013 336/223

(Continued)

FOREIGN PATENT DOCUMENTS

CN 1881488 A 12/2006
JP 2005-129590 A 5/2005

(Continued)

OTHER PUBLICATIONS

Non-final Office Action dated Jun. 21, 2019 issued in corresponding Taiwanese Patent Application No. TW 107123462 with English translation.

(Continued)

*Primary Examiner* — Elvin G Enad
*Assistant Examiner* — Malcolm Barnes
(74) *Attorney, Agent, or Firm* — Pillsbury Winthrop Shaw Pittman, LLP

(57) ABSTRACT

One object is to provide a magnetic coupling coil component having an improved coupling coefficient. A coil component according to one embodiment of the present invention includes: an insulator body; and first and second coil conductors embedded in the insulator body and wound around a coil axis. A first coil surface of the first coil conductor is opposed to a second coil surface of the second coil conductor. The insulator body includes: an intermediate portion disposed between the first coil surface and the second coil surface; a core portion disposed inside the first and second coil conductors; and an outer peripheral portion disposed outside the first and second coil conductors. A magnetic permeability of the intermediate portion in a direction perpendicular to the coil axis is smaller than those of the core
(Continued)

portion and the outer peripheral portion in a direction parallel to the coil axis.

14 Claims, 7 Drawing Sheets

(51) Int. Cl.
*H01F 38/14* (2006.01)
*H01F 27/32* (2006.01)
*H01F 27/02* (2006.01)
*H01F 17/00* (2006.01)

(52) U.S. Cl.
CPC ..... *H01F 27/324* (2013.01); *H01F 27/327* (2013.01); *H01F 38/14* (2013.01); *H01F 2017/0093* (2013.01)

(56) References Cited

U.S. PATENT DOCUMENTS

2006/0268457 A1 11/2006 Sano
2009/0002117 A1* 1/2009 Kawarai ..... H01F 17/04 336/233
2009/0003191 A1* 1/2009 Inuzuka ..... H01F 17/0013 369/283
2010/0308949 A1* 12/2010 Lim ..... H01F 17/04 336/218
2012/0119866 A1* 5/2012 Kim ..... B32B 18/00 336/200
2012/0268230 A1* 10/2012 Kim ..... H01F 17/04 336/200
2013/0169404 A1* 7/2013 Jeong ..... H01F 3/14 336/200
2013/0249662 A1* 9/2013 Tonoyama ..... H01F 17/0013 336/200
2013/0321118 A1* 12/2013 An ..... B32B 18/00 336/212
2014/0097927 A1* 4/2014 Yamamoto ..... H01F 27/255 336/200
2014/0197917 A1* 7/2014 Naito ..... H01F 1/344 336/200
2014/0203901 A1 7/2014 Chamura et al.
2015/0102889 A1* 4/2015 Choi ..... H01F 27/292 336/200
2016/0293316 A1* 10/2016 Park ..... H01F 17/0013
2016/0293319 A1* 10/2016 Hong ..... H01F 17/04
2017/0004915 A1* 1/2017 Park ..... H01F 27/255
2018/0019050 A1* 1/2018 Min ..... H01F 27/323
2018/0061561 A1* 3/2018 Sim ..... H01F 17/04

FOREIGN PATENT DOCUMENTS

JP 2009-117676 A 5/2009
JP 2015-073052 A 4/2015
JP 2016-131208 A 7/2016
TW 201320122 A 5/2013

OTHER PUBLICATIONS

Notice of Reasons for Refusal dated Jul. 27, 2021, issued in corresponding Japanese Patent Application No. 2017-142416, with English translation (6 pgs.).

* cited by examiner

COIL COMPONENT

CROSS-REFERENCE TO RELATED APPLICATIONS

This application is based on and claims the benefit of priority from Japanese Patent Application Serial No. 2017-142416 (filed on Jul. 24, 2017), the contents of which are hereby incorporated by reference in their entirety.

TECHNICAL FIELD

The present invention relates to a coil component, and in particular to a magnetic coupling coil component including a pair of coil conductors magnetically coupled to each other.

BACKGROUND

A magnetic coupling coil component includes a pair of coil conductors magnetically coupled to each other. Examples of magnetic coupling coil component including a pair of coil conductors magnetically coupled to each other include a common mode choke coil, a transformer, and a coupled inductor. In most cases, such a magnetic coupling coil component preferably has a high coupling coefficient between the pair of coil conductors.

There has been conventionally known an assembled coupled inductor. Examples of assembled coupled inductor are disclosed in Japanese Patent Application Publication No. 2005-129590 ("the '590 Publication") and Japanese Patent Application Publication No. 2009-117676 ("the '676 Publication"). As disclosed in these literatures, an assembled coupled inductor includes two plate-shaped conductors and a pair of magnetic members (a lower magnetic member and an upper magnetic member) sandwiching the two conductors. In the '590 Publication and the '676 Publication, it is proposed that a magnetic gap be provided between the two conductors to increase the coupling coefficient between the two conductors. In the coupled inductors disclosed in these literatures, the magnetic gap between the two conductors reduces leakage inductance between the two conductors.

However, in assembled coupled inductors, there are limits of accuracy in working and assembling the two conductors and the magnetic members, and therefore, it is difficult to provide the magnetic gaps with a constant size and a constant arrangement. This makes it difficult to obtain a constant coupling coefficient in assembled coupled inductors.

Further, assembled magnetic coupling coil components are less susceptible to downsizing as compared to laminated coil components produced by a lamination process and thin film coil components produced by a thin film process.

A magnetic coupling coil component produced by a lamination process is disclosed in Japanese Patent Application Publication No. 2016-131208 ("the '208 Publication"). This coupling coil component includes a plurality of laminated coil units embedded in an insulator. The plurality of coil units are configured such that the winding axes of the coil conductors of the coil units are substantially aligned with each other and the coil units are tightly contacted with each other, thereby facilitating coupling between the coil conductors.

In the conventional magnetic coupling coil component as disclosed in the '208 Publication, a leakage magnetic flux passing between the two coil conductors produces a leakage inductance. The leakage inductance degrades the coupling coefficient in the magnetic coupling coil component.

As described above, it is required to facilitate coupling between two coil conductors in a magnetic coupling coil component. There is also a high demand for downsizing magnetic coupling coil components.

SUMMARY

One object of the present invention is to improve magnetic coupling coil components. One particular object of the present invention is to provide a magnetic coupling coil component having an improved coupling coefficient. Another particular object of the present invention is to provide a downsized magnetic coupling coil component having an improved coupling coefficient. Other objects of the present invention will be apparent with reference to the entire description in this specification.

A coil component according to one embodiment of the present invention comprises: an insulator body; a first coil conductor embedded in the insulator body and wound around a coil axis; and a second coil conductor embedded in the insulator body and wound around the coil axis. A first coil surface of the first coil conductor is opposed to a second coil surface of the second coil conductor. The insulator body includes: an intermediate portion disposed between the first coil surface and the second coil surface; a core portion disposed inside the first coil conductor and the second coil conductor; and an outer peripheral portion disposed outside the first coil conductor and the second coil conductor. A magnetic permeability of the intermediate portion in a direction perpendicular to the coil axis is smaller than those of the core portion and the outer peripheral portion in a direction parallel to the coil axis. The magnetic permeability of the intermediate portion in any direction perpendicular to the coil axis and centered at the coil axis may be smaller than those of the core portion and the outer peripheral portion in the direction parallel to the coil axis, and the average magnetic permeability of the intermediate portion in the direction perpendicular to the coil axis may be smaller than the average magnetic permeability of the core portion in the direction parallel to the coil axis and the average magnetic permeability of the outer peripheral portion in the direction parallel to the coil axis. The average magnetic permeability of the intermediate portion in the direction perpendicular to the coil axis may be the average of the magnetic permeability in a first direction perpendicular to the coil axis and the magnetic permeability in a second direction perpendicular to the coil axis. The first direction and the second direction may be perpendicular to each other. In one embodiment of the present invention, the intermediate portion is formed of a non-magnetic material. In one embodiment of the present invention, the intermediate portion is formed of an anisotropic magnetic material having an easy magnetization direction parallel to the coil axis.

According to the above embodiment, the magnetic flux generated from the first coil conductor does not pass through the intermediate portion disposed between the first coil conductor and the second coil conductor but passes through a closed magnetic path liked with the second coil conductor. Therefore, less leakage magnetic flux occurs between the first coil conductor and the second coil conductor. Therefore, in the coil component according to the above embodiment, the coupling coefficient can be improved as compared to conventional magnetic coupling coil components.

In one embodiment of the present invention, the intermediate portion has a larger resistance value than the core portion. In one embodiment of the present invention, the intermediate portion has a larger resistance value than the outer peripheral portion.

According to the above embodiment, even when the intermediate portion has a small thickness, electric insulation between the first coil conductor and the second coil conductor can be ensured. Therefore, the coil component can be reduced in size (profile).

A coil component according to another embodiment of the present invention comprises: an insulator body; an insulating substrate embedded in the insulator body; a first coil conductor formed on one surface of the insulating substrate and wound around a coil axis; and a second coil conductor formed on another surface of the insulating substrate and wound around the coil axis. A magnetic permeability of the insulating substrate in a direction perpendicular to the coil axis is smaller than that in a direction parallel to the coil axis.

According to the above embodiment, the magnetic flux generated from the first coil conductor passes through the insulating substrate in the direction parallel to the coil axis, not in the direction perpendicular to the coil axis. Therefore, less leakage magnetic flux occurs between the first coil conductor and the second coil conductor. Therefore, in the coil component according to the above embodiment, the coupling coefficient can be improved as compared to conventional magnetic coupling coil components.

Advantages

According to one embodiment of the present invention, a magnetic coupling coil component having an improved coupling coefficient can be obtained.

DESCRIPTION OF THE EMBODIMENTS

Various embodiments of the invention will be described hereinafter with reference to the drawings. Elements common to a plurality of drawings are denoted by the same reference signs throughout the plurality of drawings. It should be noted that the drawings do not necessarily appear in accurate scales, for convenience of description.

Figure 1:
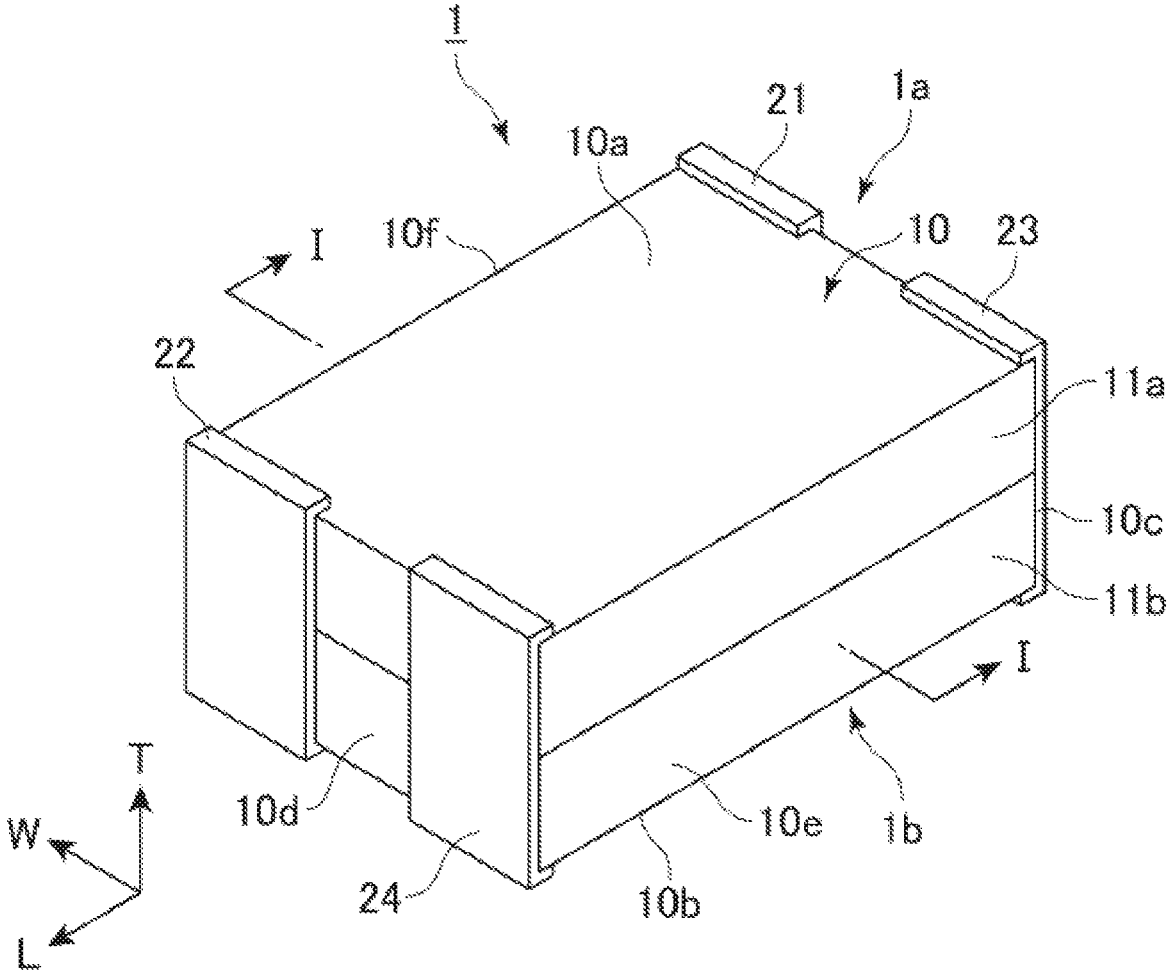
FIG. 1 is a perspective view of a coil component according to one embodiment of the present invention.
Figure 2:
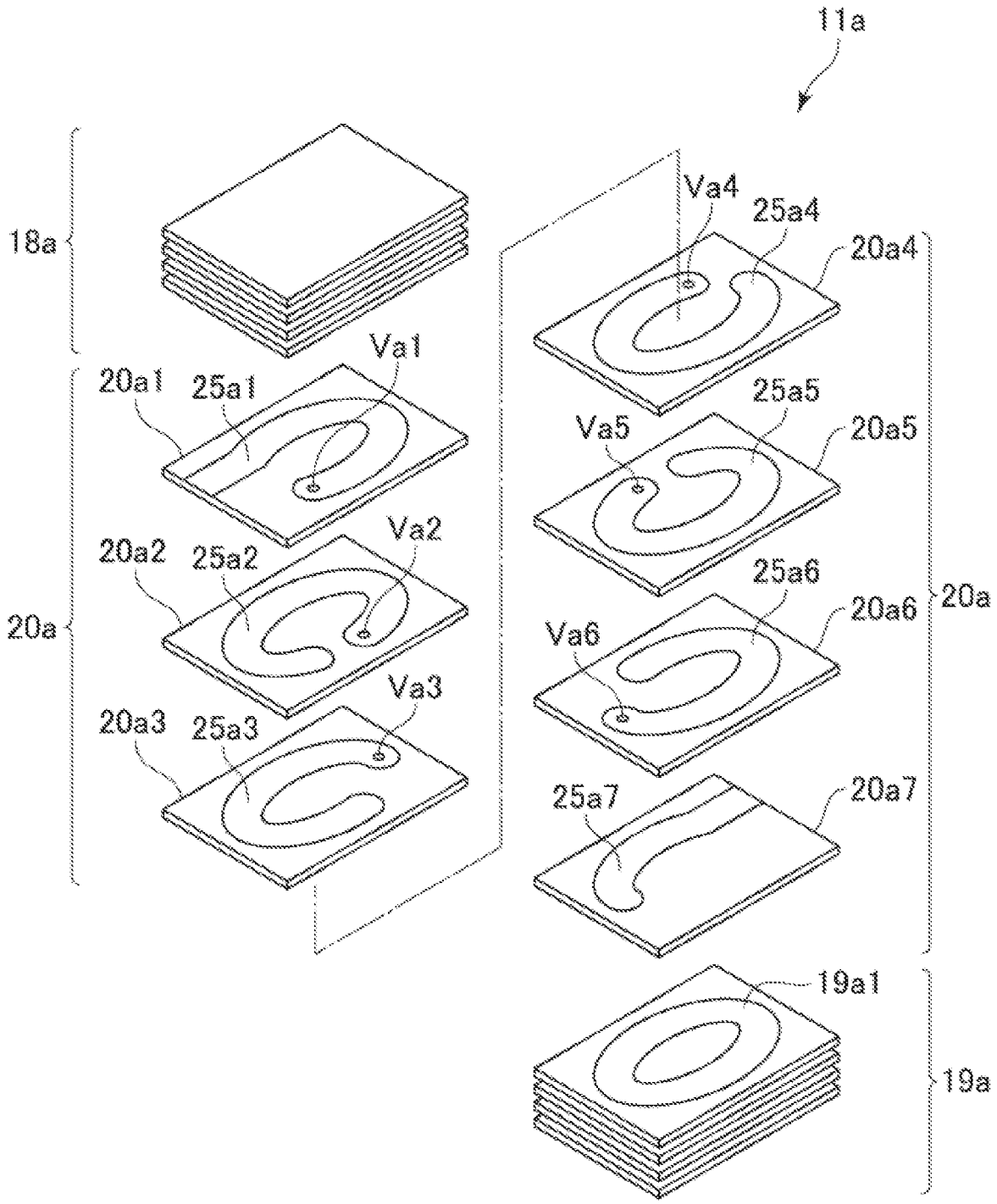
FIG. 2 is an exploded perspective view of one of two coil units included in the coil component of FIG. 1.
Figure 3:
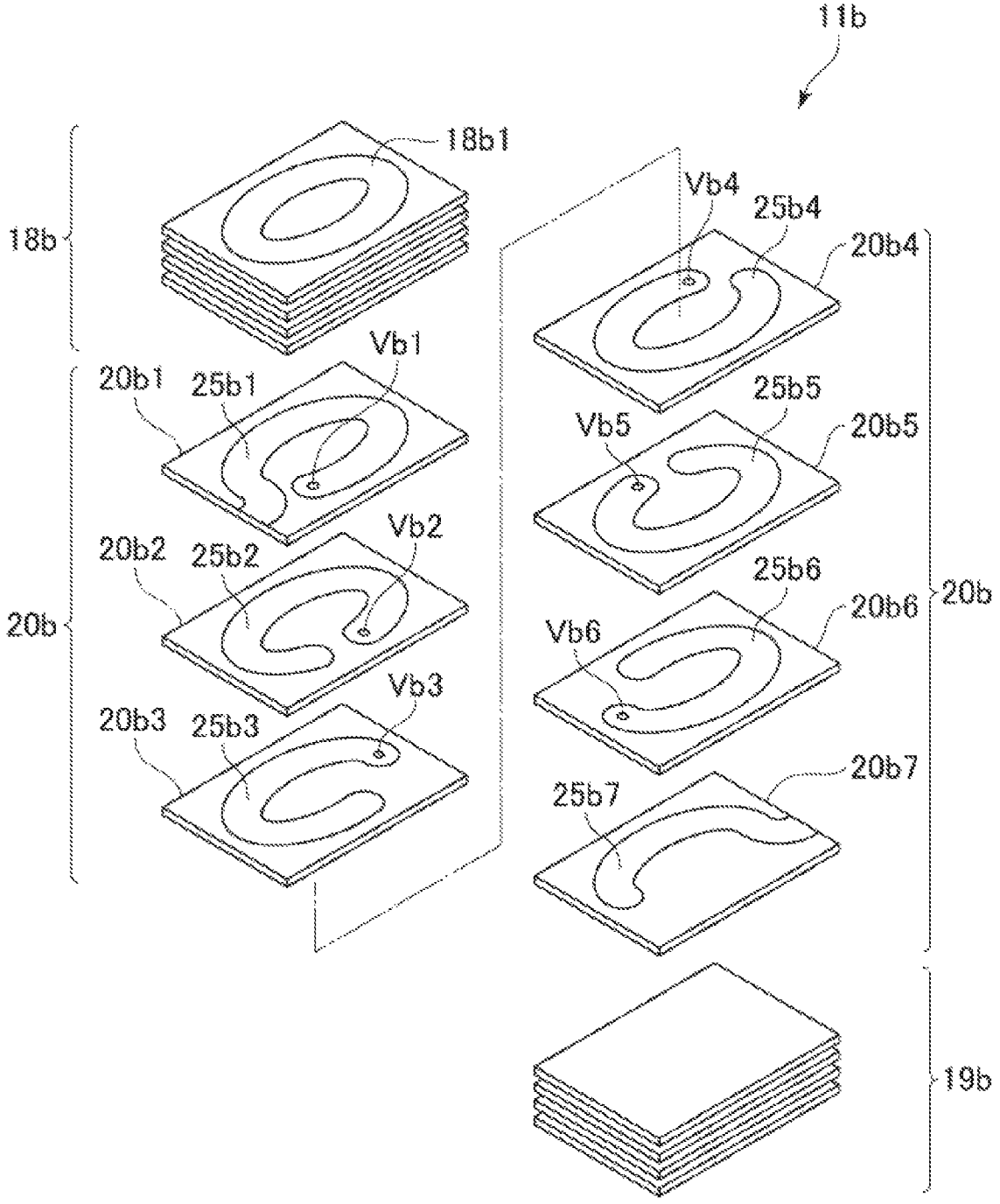
FIG. 3 is an exploded perspective view of the other of the two coil units included in the coil component of FIG. 1.

A coil component 1 according to one embodiment of the present invention will be hereinafter described with reference to FIGS. 1 to 3. FIG. 1 is a perspective view of a coil component 1 according to one embodiment of the present invention, FIG. 2 is an exploded perspective view of a coil unit 1*a* included in the coil component 1 of FIG. 1, and FIG. 3 is an exploded perspective view of a coil unit 1*b* included in the coil component 1 of FIG. 1.

These drawings show, as one example of the coil component 1, a common mode choke coil for eliminating common mode noise from a differential transmission circuit that transmits a differential signal. A common mode choke coil is one example of a magnetic coupling coil component to which the present invention is applicable. As will be described later, a common mode choke coil is produced by a lamination process or a thin film process. The present invention can also be applied to a transformer, a coupling inductor, and other various coil components, in addition to a common mode choke coil.

As shown, the coil component 1 according to one embodiment of the present invention includes the coil unit 1*a* and the coil unit 1*b*.

The coil unit 1*a* includes an insulator body 11*a* made of a magnetic material having an excellent insulating quality, a coil conductor 25*a* embedded in the insulator body 11*a*, an external electrode 21 electrically connected to one end of the coil conductor 25*a*, and an external electrode 22 electrically connected to the other end of the coil conductor 25*a*. The insulator body 11*a* has a rectangular parallelepiped shape.

The coil unit 1*b* is configured in the same manner as the coil unit 1*a*. More specifically, the coil unit 1*b* includes an insulator body 11*b* made of a magnetic material, a coil conductor 25*b* embedded in the insulator body 11*b*, an external electrode 23 electrically connected to one end of the coil conductor 25*b*, and an external electrode 24 electrically connected to the other end of the coil conductor 25*b*. The insulator body 11*b* has a rectangular parallelepiped shape.

The bottom surface of the insulator body 11*a* is joined to the top surface of the insulator body 11*b*. The insulator body 11*a* and the insulator body 11*b* are joined to each other to constitute an insulator body 10. Accordingly, the insulator body 10 includes the insulator body 11*a* and the insulator body 11*b* joined to the insulator body 11*a*.

The insulator body 10 has a first principal surface 10*a*, a second principal surface 10*b*, a first end surface 10*c*, a second end surface 10*d*, a first side surface 10*e*, and a second side surface 10*f*. The outer surface of the insulator body 10 is defined by these six surfaces. The first principal surface 10*a* and the second principal surface 10*b* are opposed to each other, the first end surface 10*c* and the second end surface 10*d* are opposed to each other, and the first side surface 10*e* and the second side surface 10*f* are opposed to each other.

In FIG. 1, the first principal surface 10*a* lies on the top side of the insulator body 10, and therefore, the first principal surface 10*a* may be herein referred to as "the top surface." Similarly, the second principal surface 10*b* may be referred to as "the bottom surface." The coil component 1 is disposed such that the second principal surface 10*b* faces a circuit board (not shown), and therefore, the second principal surface 10*b* may be herein referred to as "the mounting surface." Furthermore, the top-bottom direction of the coil component 1 refers to the top-bottom direction in FIG. 1.

In this specification, the "length" direction, the "width" direction, and the "thickness" direction of the coil component 1 refer to the "L" direction, the "W" direction, and the "T" direction in FIG. 1, respectively, unless otherwise construed from the context.

The external electrode 21 and the external electrode 23 are provided on the first end surface 10*c* of the insulator body 10. The external electrode 22 and the external electrode 24 are provided on the second end surface 10*d* of the insulator body 10. As shown, each of these external electrodes extends onto the top surface and the bottom surface of the insulator body 10.

As shown in FIG. 2, the insulator body 11*a* includes an insulator portion 20*a*, a top cover layer 18*a* provided on the top surface of the insulator portion 20*a*, and a bottom cover layer 19*a* provided on the bottom surface of the insulator portion 20*a*.

The insulator portion 20*a* includes insulating layers 20*a*1 to 20*a*7 stacked together. The insulator body 11*a* includes the top cover layer 18*a*, the insulating layer 20*a*1, the insulating layer 20*a*2, the insulating layer 20*a*3, the insulating layer 20*a*4, the insulating layer 20*a*5, the insulating layer 20*a*6, the insulating layer 20*a*7, the bottom cover layer 19*a* that are stacked in this order from the positive side to the negative side in the direction of the axis T.

The insulating layers 20*a*1 to 20*a*7 contain a resin and a large number of filler particles. The filler particles are dispersed in the resin. The insulating layers 20*a*1 to 20*a*7 may not contain the filler particles.

In one embodiment of the present invention, the insulating layers 20*a*1 to 20*a*7 may contain flat-shaped filler particles. The flat-shaped filler particles are contained in the insulating layers so as to assume such a position that the longest axes thereof are parallel to the axis T (corresponding to the coil axis CL described later) and the short axes thereof are perpendicular to the coil axis CL. With the filler particles made of the magnetic material assuming such a position, the magnetic permeability of individual ones of the insulating layers 20*a*1 to 20*a*7 in the direction parallel to the axis T is larger than that in the direction perpendicular to the axis T. Thus, the insulating layers 20*a*1 to 20*a*7 have an easy magnetization direction parallel to the axis T and a hard magnetization direction perpendicular to the axis T. To ensure that the insulating layers 20*a*1 to 20*a*7 have an easy magnetization direction parallel to the axis T and a hard magnetization direction perpendicular to the axis T, it is not necessary that all the filler particles contained in the insulating layers 20*a*1 to 20*a*7 have the longest axes thereof oriented accurately perpendicular to the axis T.

On the top surfaces of the insulating layers 20*a*1 to 20*a*7, there are provided conductive patterns 25*a*1 to 25*a*7, respectively. The conductive patterns 25*a*1 to 25*a*7 are formed by applying a conductive paste made of a metal or alloy having an excellent electrical conductivity by screen printing. The conductive paste may be made of Ag, Pd, Cu, Al, or an alloy thereof. The conductive patterns 25*a*1 to 25*a*7 may be formed by other methods using other materials.

The insulating layers 20*a*1 to 20*a*6 are provided with vias Va1 to Va6, respectively, at predetermined positions therein. The vias Va1 to Va6 are formed by drilling through-holes at predetermined positions in the insulating layers 20*a*1 to 20*a*6 so as to extend through the insulating layers 20*a*1 to 20*a*6 in the direction of the axis T and filling the conductive paste into the through-holes.

Each of the conductive patterns 25*a*1 to 25*a*7 is electrically connected to adjacent ones via the vias Va1 to Va6. The conductive patterns 25*a*1 to 25*a*7 connected in this manner form a coil conductor 25*a* having a spiral shape. In other words, the coil conductor 25*a* includes the conductor patterns 25*a*1 to 25*a*7 and the vias Va1 to Va6.

The end of the conductive pattern 25*a*1 opposite to the other end connected to the via Va1 is connected to the external electrode 22. The end of the conductive pattern 25*a*7 opposite to the other end connected to the via Va6 is connected to the external electrode 21.

The top cover layer 18*a* is a laminate including a plurality of insulating layers stacked together. Similarly, the bottom cover layer 19*a* is a laminate including a plurality of insulating layers stacked together. Each of the insulating layers constituting the top cover layer 18*a* and the bottom cover layer 19*a* is made of a resin containing a large number of filler particles dispersed therein. These insulating layers may not contain the filler particles.

In one embodiment of the present invention, the bottom cover layer 19*a* includes an annular portion 19*a*1 having an annular shape in plan view. The shape of the annular portion 19*a*1 corresponds to the plane shape of the coil conductor 25*a* in plan view. For example, the coil conductor 25*a* has a spiral shape formed by connecting the conductive patterns 25*a*1 to 25*a*7 via the vias Va1 to Va6, the spiral shape appearing nearly oval in plan view. In this case, the annular portion 19*a*1 has an oval shape that corresponds to the shape of the coil conductor 25*a* in plan view. The annular portion 19*a*1 is positioned inside the outline of the plane shape of the coil conductor 25*a* in plan view. For example, the annular portion 19*a*1 has an oval shape with a long axis and a short axis slightly shorter than those of the oval defining the outline of the coil conductor 25*a*.

In one embodiment of the present invention, the annular portion 19*a*1 is formed of a non-magnetic material. The non-magnetic material forming the annular portion 19*a*1 may be glass, Zn ferrite, or other well known non-magnetic materials. The non-magnetic material forming the annular portion 19*a*1 may include particles of metal oxides such as silica particles, zirconia particles, and alumina particles.

In one embodiment of the present invention, the annular portion 19*a*1 is formed of an anisotropic magnetic material having an easy magnetization direction parallel to the coil axis CL. The anisotropic magnetic material is, for example, a composite magnetic material containing a resin and flat-shaped filler particles. The filler particles are contained in the resin and oriented so as to assume such a position that the longest axes thereof are parallel to the axis T and the short axes thereof are perpendicular to the coil axis CL. With the filler particles assuming such a position, a magnetic permeability of the annular portion 19*a*1 in the direction parallel to the axis T is larger than that in the direction perpendicular to the axis T. Thus, the annular portion 19*a*1 has an easy magnetization direction parallel to the axis T and a hard magnetization direction perpendicular to the axis T.

To ensure that the annular portion 19*a*1 has an easy magnetization direction parallel to the axis T and a hard magnetization direction perpendicular to the axis T, it is not necessary that all the filler particles contained in the annular portion 19*a*1 have the longest axes thereof oriented accurately perpendicular to the axis T.

The annular portion 19*a*1 is formed by preparing a plurality of sheets formed of the above non-magnetic material or the anisotropic magnetic material, cutting each of the plurality of sheets into the same shape as the coil conductor 25*a* in plan view (an annular shape in the illustrated embodiment), and stacking the cut sheets together. A resin containing filler particles is applied by printing around the annular portion 19*a*1 formed as described above, thereby to complete the bottom cover layer 19*a*.

The resin contained in the insulating layers 20*a*1 to 20*a*7, the insulating layers constituting the top cover layer 18*a*, the insulating layers constituting the bottom cover layer 19*a*, and the annular portion 19*a*1 is a thermosetting resin having an excellent insulating quality. Examples of such a resin include an epoxy resin, a polyimide resin, a polystyrene (PS) resin, a high-density polyethylene (HDPE) resin, a polyoxymethylene (POM) resin, a polycarbonate (PC) resin, a polyvinylidene fluoride (PVDF) resin, a phenolic resin, a polytetrafluoroethylene (PTFE) resin, or a polybenzoxazole (PBO) resin. The resin contained in one sheet is either the same as or different from the resin contained in another sheet.

The filler particles contained in the insulating layers 20*a*1 to 20*a*7, the insulating layers constituting the top cover layer 18*a*, the bottom cover layer 19*a*, and the annular portion 19*a*1 are particles of a ferrite material, metal magnetic particles, particles of an inorganic material such as $SiO_2$ or $Al_2O_3$, or glass-based particles. Particles of a ferrite material applicable to the present invention are, for example, particles of Ni—Zn ferrite or particles of Ni—Zn—Cu ferrite. Metal magnetic particles applicable to the present invention are made of a material in which magnetism is developed in an unoxidized metal portion, and are, for example, particles including unoxidized metal particles or alloy particles. Metal magnetic particles applicable to the present invention include particles of, for example, a Fe—Si—Cr, Fe—Si—At or Fe—Ni alloy, a Fe—Si—Cr—B—C or Fe—Si—B—Cr amorphous alloy, Fe, or a mixture thereof. Metal magnetic particles applicable to the present invention further include particles of Fe—Si—Al or Fe—Si—Al—Cr. Powder compacts made of these types of particles can also be used as the metal magnetic particles of the present invention. Moreover, these types of particles or powder compacts each having a surface thermally treated to form an oxidized film thereon can also be used as the metal magnetic particles of the present invention. The metal magnetic particles applicable to the present invention are manufactured by, for example, an atomizing method. Furthermore, the metal magnetic particles applicable to the present invention can be manufactured by a known method. Furthermore, commercially available metal magnetic particles can also be used in the present invention. Examples of commercially available metal magnetic particles include PF-20F manufactured by Epson Atmix Corporation and SFR—FeSiAl manufactured by Nippon Atomized Metal Powders Corporation.

The flat-shaped filler particles contained in the insulating layers 20*a*1 to 20*a*7 and the annular portion 19*a*1 have an aspect ratio (a flattening ratio) of, for example, 1.5 or more, 2 or more, 3 or more, 4 or more, or 5 or more. An aspect ratio of filler particles refers to a length of the particles in a longest axis direction with respect to a length thereof in a shortest axis direction (a length in the longest axis direction/a length in the shortest axis direction).

As described above, the annular portion 19*a*1 is formed of a non-magnetic material or an anisotropic magnetic material having an easy magnetization direction parallel to the axis T (the coil axis CL). In one embodiment of the present invention, the magnetic permeability of the annular portion 19*a*1 in the direction perpendicular to the axis T is smaller than that of the insulator portion 20*a* in the direction parallel to the axis T (the coil axis CL) and that of the bottom cover layer 19*a* in the direction parallel to the axis T (the coil axis CL). The magnetic permeability of the annular portion 19*a*1 in any direction perpendicular to the axis T and centered at the axis T may be smaller than that of the insulator portion 20*a* in the direction parallel to the axis T and that of the bottom cover layer 19*a* in the direction parallel to the axis T. When the magnetic permeability of the annular portion 19*a*1 in the direction perpendicular to the axis T is anisotropic, the average magnetic permeability of the annular portion 19*a*1 in the direction perpendicular to the axis T should be smaller than the average magnetic permeability of the insulator portion 20*a* in the direction parallel to the axis T and the average magnetic permeability of the bottom cover layer 19*a* in the direction parallel to the axis T. The average magnetic permeability of the annular portion 19*a*1 in the direction perpendicular to the axis T may be the average of the magnetic permeability in a first direction perpendicular to the axis T and the magnetic permeability in a second direction perpendicular to the axis T. The first direction and the second direction may be perpendicular to each other. For example, the first direction is the direction of the axis W, and the second direction is the direction of the axis L.

In one embodiment of the present invention, the annular portion 19*a*1 has a larger resistance value than the insulator portion 20*a* and the bottom cover layer 19*a*.

As described above, the coil unit 1*b* is configured in the same manner as the coil unit 1*a*. More specifically, the insulator body 11*b* includes an insulator portion 20*b*, a top cover layer 18*b* provided on a top surface of the insulator portion 20*b*, and a bottom cover layer 19*b* provided on a bottom surface of the insulator portion 20*b*. The insulator portion 20*b* is configured in the same manner as the insulator portion 20*a*. More specifically, the insulator portion 20*b* includes insulating layers 20*b*1 to 20*b*7 stacked together, and each of the insulating layers 20*b*1 to 20*b*7 is configured in the same manner as the corresponding one of the insulating layers 20*a*1 to 20*a*7.

The coil conductor 25*b* is also configured in the same manner as the coil conductor 25*a*. More specifically, the coil conductor 25*b* includes conductive patterns 25*b*1 to 25*b*7. Each of the conductive patterns 25*b*1 to 25*b*7 is formed on the top surface of the corresponding one of the insulating layers 20*b*1 to 20*b*7. Each of the conductive patterns 25*b*1 to 25*b*7 is electrically connected to adjacent ones via the vias Vb1 to Vb6. The end of the conductive pattern 25*b*1 opposite to the other end connected to the via Vb1 is connected to the external electrode 24. The end of the conductive pattern 25*b*7 opposite to the other end connected to the via Vb6 is connected to the external electrode 23.

The bottom cover layer 19*b* is configured in the same manner as the top cover layer 18*a*. More specifically, the bottom cover layer 19*b* is a laminate including a plurality of insulating layers stacked together.

The top cover layer 18*b* is configured in the same manner as the bottom cover layer 19*a*. More specifically, the top cover layer 18*b* is a laminate including a plurality of insulating layers stacked together. In one embodiment of the present invention, the top cover layer 18*b* includes an annular portion 18*b*1 having an annular shape in plan view. The shape of the annular portion 18*b*1 corresponds to the plane shape of the coil conductor 25*b* in plan view. In one embodiment of the present invention, the coil conductor 25*b* has the same plane shape as the coil conductor 25*a*. In this case, the annular portion 18*b*1 has the same plane shape as the annular portion 19*a*1. The annular portion 18*b*1 is positioned inside the outline of the plane shape of the coil conductor 25*b* in plan view. For example, the annular portion 18*b*1 has an oval shape with a long axis and a short axis slightly shorter than those of the oval defining the outline of the coil conductor 25*b*.

The annular portion 18*b*1 may be formed of the same material by the same method as the annular portion 19*a*1.

In one embodiment of the present invention, the annular portion 18*b*1 is formed of a non-magnetic material or an anisotropic magnetic material having an easy magnetization direction parallel to the axis T (the coil axis CL). In one embodiment of the present invention, the magnetic permeability of the annular portion 18*b*1 in the direction perpendicular to the axis T is smaller than those of the insulator portion 20*b* and the top cover layer 18*b* in the direction parallel to the axis T (the coil axis CL). The magnetic permeability of the annular portion 18*b*1 in any direction perpendicular to the axis T and centered at the axis T may be smaller than that of the insulator portion 20*b* in the direction parallel to the axis T and that of the top cover layer 18*b* in the direction parallel to the axis T. When the magnetic permeability of the annular portion 18*b*1 in the direction perpendicular to the axis T is anisotropic, the average magnetic permeability of the annular portion 18*b*1 in the direction perpendicular to the axis T should be smaller than the magnetic permeability of the insulator portion 20*b* in the direction parallel to the axis T and the magnetic permeability of the top cover layer 18*b* in the direction parallel to the axis T. The average magnetic permeability of the annular portion 18*b*1 in the direction perpendicular to the axis T may be the average of the magnetic permeability in a first direction perpendicular to the axis T and the magnetic permeability in a second direction perpendicular to the axis T. The first direction and the second direction may be perpendicular to each other. For example, the first direction is the direction of the axis W, and the second direction is the direction of the axis L.

In one embodiment of the present invention, the annular portion 18*b*1 has a larger resistance value than the insulator portion 20*b* and the top cover layer 18*b*.

Each of the constituents of the coil unit 1*b* is formed of the same material by the same method as the corresponding one of the constituents of the coil unit 1*a*. Therefore, those skilled in the art can grasp the materials and the production methods of the constituents of the coil unit 1*b* by referring to the explanation related to the constituents of the coil unit 1*a*.

The coil component 1 can be obtained by joining the coil unit 1*a* and the coil unit 1*b* described above. The coil component 1 includes a first coil (the coil conductor 25*a*) and a second coil (the coil conductor 25*b*), the first coil positioned between the external electrode 21 and the external electrode 22, the second coil positioned between the external electrode 23 and the external electrode 24. These two coils are respectively connected to two signal lines in a differential transmission circuit, for example. Thus, the coil component 1 can operate as a common mode choke coil.

The coil component 1 may include a third coil (not shown). The coil component 1 having the third coil additionally includes another coil unit configured in the same manner as the coil unit 1*a*. As with the coil unit 1*a* and the coil unit 1*b*, the additional coil unit includes a coil conductor that is connected to additional external electrodes. The coil component including three coils is used as a common mode choke coil for a differential transmission circuit having three signal lines, for example.

Next, a description is given of an example of a production method of the coil component 1. The coil component 1 can be produced by, for example, a lamination process. First, the coil unit 1*a* and the coil unit 1*b* are produced. Since the coil unit 1*a* and the coil unit 1*b* can be produced by the same method, only the production method of the coil unit 1*a* will be described.

Specifically, the coil unit 1*a* is produced through the following steps. The first step is to produce the insulating layers 20*a*1 to 20*a*7, the insulating layers constituting the top cover layer 18*a*, and the insulating layers constituting the bottom cover layer 19*a*.

More specifically, to produce these insulating layers, a thermosetting resin (e.g., epoxy resin) having filler particles dispersed therein is mixed with a solvent to produce a slurry. The filler particles have a spherical or flat shape. The slurry is applied to a surface of a base film made of a plastic and then dried, and the dried slurry is cut to a predetermined size to obtain magnetic sheets to be used as the insulating layers 20*a*1 to 20*a*7, the insulating layers constituting the top cover layer 18*a*, and the insulating layers constituting the bottom cover layer 19*a*. When the filler particles have a flat shape, the filler particles are oriented such that the longest axis direction thereof is parallel to the axis T (the coil axis CL). The filler particles are oriented by any known method such as magnetic ordering. In magnetic ordering, while the resin in the slurry retains fluidity, the filler particles can be oriented in a direction by applying in a given direction a magnetic field to the slurry formed into a predetermined shape.

Next, the annular portion 19*a*1 is formed in the insulating layers constituting the bottom cover layer 19*a*. The annular portion 19*a*1 is formed by preparing a plurality of sheets formed of the non-magnetic material or the anisotropic magnetic material, cutting each of the plurality of sheets into a shape corresponding to the shape of the coil conductor 25*a* in plan view (an annular shape in the illustrated embodiment), and stacking the cut sheets together.

The anisotropic magnetic material sheets include, for example, filler particles oriented such that the longest axes thereof are oriented in the thickness direction. In this case, the plurality of anisotropic magnetic material sheets cut into a predetermined shape are stacked together to form the annular portion 19*a*1 having an easy magnetization direction parallel to the thickness direction and a hard magnetization direction perpendicular to the thickness direction.

It is also possible to produce the annular portion 19*a*1 with anisotropic magnetic material sheets including filler particles oriented such that the short axes thereof are oriented in the thickness direction. In these anisotropic magnetic material sheets, the long axes of the filler particles are oriented in the surface direction (the direction perpendicular to the thickness direction). In this case, a plurality of such anisotropic magnetic material sheets are first stacked together to form a laminate. Next, the laminate is cut into sheets along the direction perpendicular to the lamination direction thereof to form sheet bodies. In the sheet bodies, the short axes of the filler particles are oriented in the surface direction of the sheet bodies. The sheet bodies are cut into a shape corresponding to the shape of the coil conductor 25*a* and stacked together to form the annular portion 19*a*1. In the annular portion 19*a*1 thus obtained, the short axes of the filler particles are oriented in the direction perpendicular to the axis T, and therefore, the easy magnetization direction is parallel to the thickness direction and the hard magnetization direction is perpendicular to the thickness direction. Accordingly, the average magnetic permeability of the annular portion 19*a*1 in the direction perpendicular to the axis T is smaller than the average magnetic permeability of the annular portion 19*a*1 in the direction parallel to the axis T.

The annular portion 19*a*1 may also be produced by other methods. For example, an anisotropic magnetic material sheet including filler particles oriented such that the short axes thereof are oriented in the thickness direction is rolled around a shaft to form a roll. The roll is cut along the direction perpendicular to the shaft into a large number of pieces, and these pieces are arranged in an annular shape to produce the annular portion 19*a*1.

A resin containing filler particles is applied by printing around the annular portion 19*a*1 formed as described above, thereby to complete the bottom cover layer 19*a*.

Next, through-holes are formed at predetermined positions in the magnetic sheets to be used as the insulating layers 20*a*1 to 20*a*7, so as to extend through the magnetic sheets in the direction of the axis T.

Next, a conductive paste made of a metal material (e.g. Ag) is applied by screen printing to the top surfaces of the magnetic sheets to be used as the insulating layers 20*a*1 to 20*a*7, and the metal paste is filled into the through-holes formed in the magnetic sheets. The metal material filled into the through-holes forms the vias Va1 to Va6.

Next, the magnetic sheets to be used as the insulating layers 20*a*1 to 20*a*7 are stacked together to form a coil laminate to be used as the insulator portion 20*a*. The magnetic sheets to be used as the insulating layers 20*a*1 to 20*a*7 are stacked together such that the conductive patterns 25*a*1 to 25*a*7 formed on the magnetic sheets are each electrically connected to adjacent conductive patterns through the vias Va1 to Va6.

Next, the magnetic sheets for forming the top cover layer 18*a* are stacked together to form a top cover layer laminate that corresponds to the top cover layer 18*a*, and the magnetic sheets for forming the bottom cover layer 19*a* are stacked together to form a bottom cover layer laminate that corresponds to the bottom cover layer 19*a*.

The same steps are performed to form a coil laminate to be used as the insulator portion 20*b*, a top cover layer laminate corresponding to the top cover layer 18*b*, and the bottom cover layer laminate corresponding to the bottom cover layer 19*b*.

Next, the bottom cover layer laminate to be used as the bottom cover layer 19*b*, the coil laminate to be used as the insulator portion 20*b*, the top cover layer laminate to be used as the top cover layer 18*b*, the bottom cover layer laminate to be used as the bottom cover layer 19*a*, the coil laminate to be used as the insulator portion 20*a*, and the top cover layer laminate to be used as the top cover layer 18*a* are stacked together in this order and bonded together by thermal compression using a pressing machine to obtain a body laminate.

Next, the body laminate is segmented to a desired size by using a cutter such as a dicing machine or a laser processing machine to obtain a chip laminate corresponding to the insulator body 11*a*. Next, the chip laminate is degreased and then heated.

Next, a conductive paste is applied to both end portions of the heated chip laminate to form the external electrode 21, the external electrode 22, the external electrode 23, and the external electrode 24. Thus, the coil component 1 is obtained.

Figure 4:
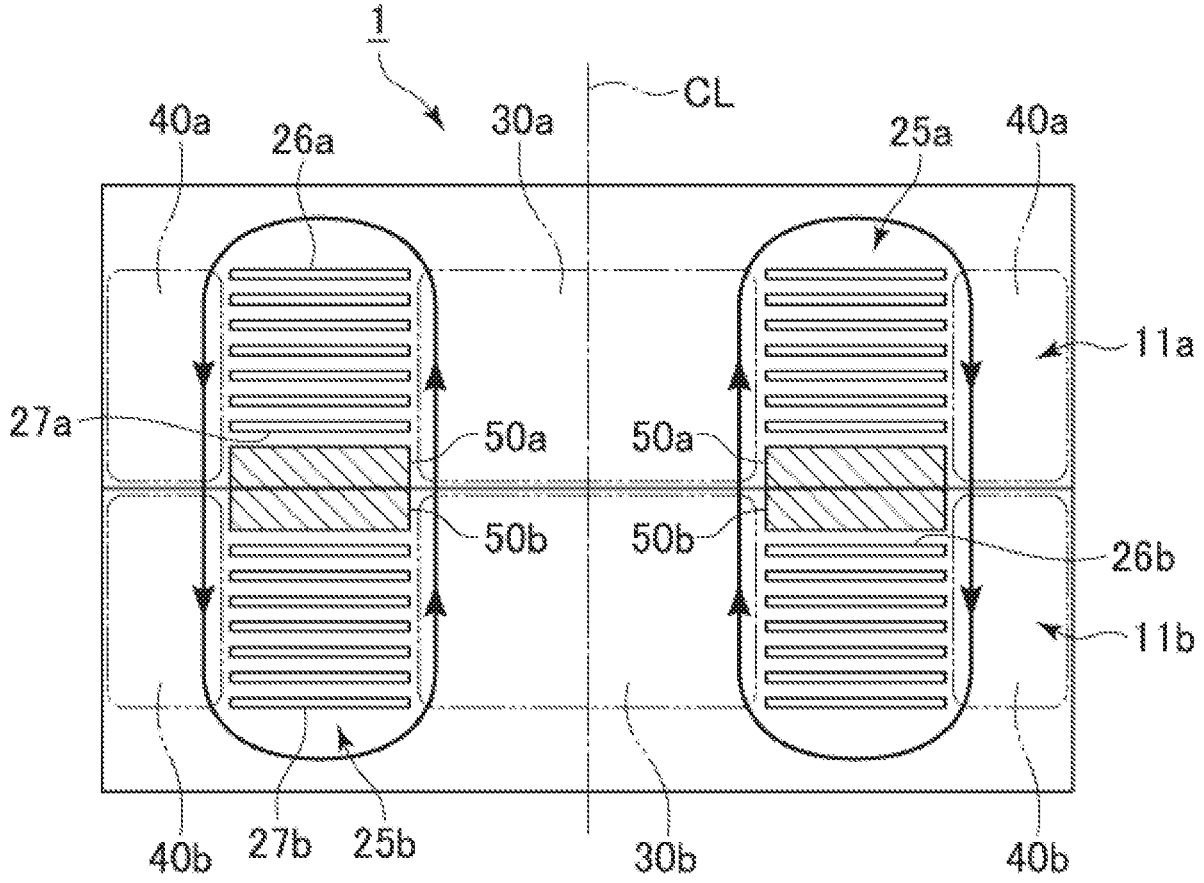
FIG. 4 schematically shows a cross section of the coil component of FIG. 1 cut along the line I-I.

Next, a description is given of magnetic flux generated in the coil component 1 with reference to FIG. 4. FIG. 4 schematically shows a cross section of the coil component of FIG. 1 cut along the line I-I. In FIG. 4, the magnetic flux (the lines of magnetic force) generated from the coil conductor is represented by arrows. In FIG. 4, the boundaries between the individual insulating layers are omitted for convenience of description. Further, the external electrodes 21 to 24 are also not shown.

As shown, the coil conductor 25*a* is wound around the coil axis CL. The coil axis CL is an imaginary line that extends in parallel to the axis T in FIG. 1. Likewise, the coil conductor 25*b* is also wound around the coil axis CL. The coil conductor 25*a* has a top surface 26*a* and a bottom surface 27*a*, the top surface 26*a* constituting one end of the coil conductor 25*a* in the direction of the coil axis CL, the bottom surface 27*a* constituting the other end of the coil conductor 25*a* in the direction of the coil axis CL. The coil conductor 25*b* has a top surface 26*b* and a bottom surface 27*b*, the top surface 26*b* constituting one end of the coil conductor 25*b* in the direction of the coil axis CL, the bottom surface 27*b* constituting the other end of the coil conductor 25*b* in the direction of the coil axis CL. The coil conductor 25*a* is disposed such that the bottom surface 27*a* thereof is opposed to the top surface 26*b* of the coil conductor 25*b*.

The insulator body 11*a* includes a core portion 30*a* positioned inside the coil conductor 25*a*, an outer peripheral portion 40*a* positioned outside the coil conductor 25*a*, and an intermediate portion 50*a* positioned between the bottom surface 27*a* of the coil conductor 25*a* and the top surface 26*b* of the coil conductor 25*b*. The core portion 30*a* and the outer peripheral portion 40*a* are constituted by the insulator portion 20*a* and the portion of the bottom cover layer 19*a* other than the annular portion 19*a*1. The intermediate portion 50*a* is constituted by the annular portion 19*a*1.

The insulator body 11*b* includes a core portion 30*b* positioned inside the coil conductor 25*b*, an outer peripheral portion 40*b* positioned outside the coil conductor 25*b*, and an intermediate portion 50*b* positioned between the top surface 26*b* of the coil conductor 25*b* and the bottom surface 27*a* of the coil conductor 25*a*. The core portion 30*b* and the outer peripheral portion 40*b* are constituted by the insulator portion 20*b* and the portion of the top cover layer 18*b* other than the annular portion 18*b*1. The intermediate portion 50*b* is constituted by the annular portion 18*b*1.

As described above, the magnetic permeability of the annular portion 19*a*1 in the direction perpendicular to the axis T is smaller than those of the insulator portion 20*a* and the bottom cover layer 19*a* in the direction parallel to the coil axis CL. Therefore, the magnetic permeability of the intermediate portion 50*a* in the direction perpendicular to the col axis CL is smaller than those of the core portion 30*a* and the outer peripheral portion 40*a* in the direction parallel to the coil axis CL. The magnetic permeability of the intermediate portion 50*a* in any direction perpendicular to the coil axis CL and centered at the coil axis CL may be smaller than those of the core portion 30*a* and the outer peripheral portion 40*a* in the direction parallel to the coil axis CL, and the average magnetic permeability of the intermediate portion 50*a* in the direction perpendicular to the coil axis CL may be smaller than the average magnetic permeability of the core portion 30*a* in the direction parallel to the coil axis CL and the average magnetic permeability of the outer peripheral portion 40*a* in the direction parallel to the coil axis CL. The average magnetic permeability of the intermediate portion 50*a* in the direction perpendicular to the coil axis CL may be the average of the magnetic permeability in a first direction perpendicular to the coil axis CL and the magnetic permeability in a second direction perpendicular to the coil axis CL. The first direction and the second direction may be perpendicular to each other. For example, the first direction is the direction of the axis W, and the second direction is the direction of the axis L.

Likewise, the magnetic permeability of the annular portion 18*b*1 in the direction perpendicular to the coil axis CL is smaller than those of the insulator portion 20*b* and the top cover layer 18*b* in the direction parallel to the coil axis CL. Therefore, the magnetic permeability of the intermediate portion 50*b* in the direction perpendicular to the col axis CL is smaller than those of the core portion 30*b* and the outer peripheral portion 40*b* in the direction parallel to the coil axis CL. The magnetic permeability of the intermediate portion 50*b* in any direction perpendicular to the coil axis CL and centered at the coil axis CL may be smaller than those of the core portion 30*b* and the outer peripheral portion

40*b* in the direction parallel to the coil axis CL, and the average magnetic permeability of the intermediate portion 50*b* in the direction perpendicular to the coil axis CL may be smaller than the average magnetic permeability of the core portion 30*b* in the direction parallel to the coil axis CL and the average magnetic permeability of the outer peripheral portion 40*b* in the direction parallel to the coil axis CL. The average magnetic permeability of the intermediate portion 50*b* in the direction perpendicular to the coil axis CL may be the average of the magnetic permeability in a first direction perpendicular to the coil axis CL and the magnetic permeability in a second direction perpendicular to the coil axis CL. The first direction and the second direction may be perpendicular to each other. For example, the first direction is the direction of the axis W, and the second direction is the direction of the axis L.

In the coil component 1, the magnetic flux generated from the electric current flowing through the coil conductor 25*a* passes through the core portion 30*a*, the top cover layer 18*a*, and the outer peripheral portion 40*a* of the coil unit 1*a* and enters the outer peripheral portion 40*b* of the coil unit 1*b*. In the coil unit 1*b*, the magnetic flux passes through the outer peripheral portion 40*b*, the bottom cover layer 19*b*, and the core portion 30*b*, and returns to the core portion 30*a* of the coil unit 1*a*. Thus, the magnetic flux generated from the electric current flowing through the coil conductor 25*a* runs in a closed magnetic path that extends through the core portion 30*a*, the top cover layer 18*a*, the outer peripheral portion 40*a*, the outer peripheral portion 40*b*, the bottom cover layer 19*b*, and the core portion 30*b* and returns to the core portion 30*a*. Since the magnetic permeabilities of the intermediate portion 50*a* and the intermediate portion 50*b* in the direction perpendicular to the coil axis are smaller than those of the outer peripheral portion 40*a* and the outer peripheral portion 40*b* in the direction parallel to the coil axis CL, the magnetic flux passing through the outer peripheral portion 40*a* runs in a path that extends through the outer peripheral portion 40*a* in parallel to the coil axis CL and enters the outer peripheral portion 40*b*, not in a path that extends through the intermediate portion 50*a* or the intermediate portion 50*b* and returns to the core portion 30*a*. The magnetic flux generated from the electric current flowing through the coil conductor 25*b* also runs in a similar closed magnetic path. Therefore, there is less leakage magnetic flux occurring between the coil conductor 25*a* and the coil conductor 25*b* in the coil component 1. Accordingly, the coil component 1 achieves an improved coupling coefficient as compared to conventional magnetic coupling coil components liable to leakage magnetic flux between coil conductors.

In one embodiment of the present invention, the annular portion 19*a*1 has a larger resistance value than the insulator portion 20*a* and the bottom cover layer 19*a*, and therefore, the intermediate portion 50*a* has a larger resistance value than the core portion 20*a* and the outer peripheral portion 40*a*. The annular portion 18*b*1 has a larger resistance value than the insulator portion 20*b* and the top cover layer 18*b*, and therefore, the intermediate portion 50*b* has a larger resistance value than the core portion 20*b* and the outer peripheral portion 40*b*. Thus, even when the intermediate portion 50*a* and the intermediate portion 50*b* have a small thickness, electric insulation between the coil conductor 25*a* and the coil conductor 25*b* can be ensured.

The coil component 1, which is formed by the lamination process, is more susceptible to downsizing than conventional assembled coupled inductors.

When filler particles constituted by metal magnetic particles are contained in the top cover layer 18*a*, the insulator portion 20*a*, the bottom cover layer 19*a*, the top cover layer 18*b*, the insulator portion 20*b*, and the bottom cover layer 19*b*, there is less possibility of magnetic saturation in the closed magnetic path that extends through the core portion 30*a*, the top cover layer 18*a*, the outer peripheral portion 40*a*, the outer peripheral portion 40*b*, the bottom cover layer 19*b*, and the core portion 30*b*, as compared to the case where the filler particles are formed of a ferrite material. Therefore, a magnetic gap is not necessary in the closed magnetic path. As a result, the magnetic flux leakage is small.

Figure 5:
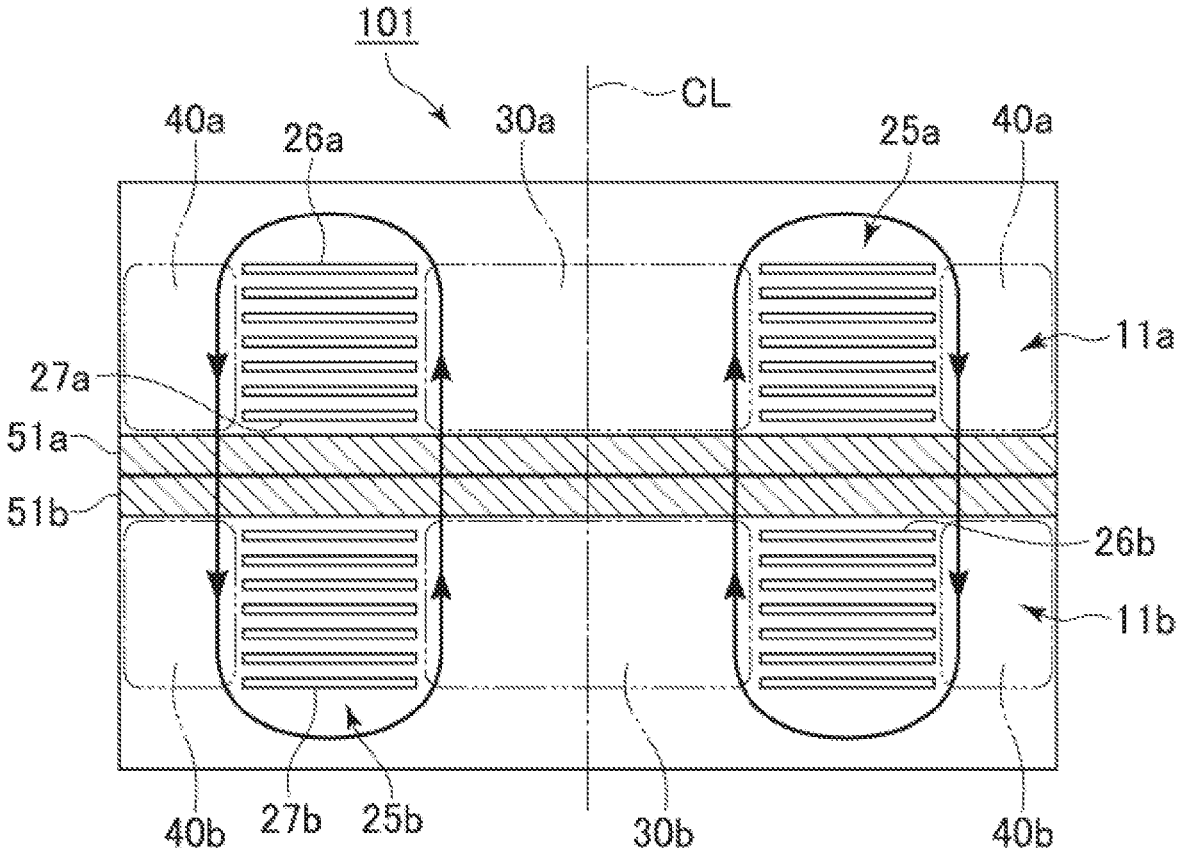
FIG. 5 schematically shows a cross section of a coil component according to another embodiment of the present invention.

Next, with reference to FIG. 5, a description is given of a coil component 101 according to another embodiment of the present invention. The coil component 101 shown in FIG. 5 includes an intermediate portion 51*a* in place of the intermediate portion 50*a* of the coil component 1 and includes an intermediate portion 51*b* in place of the intermediate portion 50*b*.

In the embodiment of FIG. 5, the intermediate portion 51*a* is constituted by the bottom cover layer 19*a*, and the intermediate portion 51*b* is constituted by the top cover layer 18*b*. The bottom cover layer 19*a* and the top cover layer 18*b* are formed of an anisotropic magnetic material having an easy magnetization direction parallel to the coil axis CL. The magnetic permeabilities of the intermediate portion 51*a* and the intermediate portion 51*b* in the direction perpendicular to the coil axis CL are smaller than those of the outer peripheral portion 40*a* and the outer peripheral portion 40*b* in the direction parallel to the coil axis CL.

The bottom cover layer 19*a* and the top cover layer 18*b* formed of this anisotropic material are stacked together with other layers to produce the coil component 101 shown in FIG. 5. That is, the coil component 101 is produced by stacking the bottom cover layer 19*b*, the insulator portion 20*b*, the top cover layer 18*b*, the bottom cover layer 19*a*, the insulator portion 20*a*, and the top cover layer 18*a* in this order and perform a heat treatment.

In the coil component 101, the magnetic flux generated from the electric current flowing through the coil conductor 25*a* passes through the core portion 30*a*, the top cover layer 18*a*, the outer peripheral portion 40*a*, and the intermediate portion 51*a* of the coil unit 1*a* and enters the intermediate portion 51*b* of the coil unit 1*b*. In the coil unit 1*b*, the magnetic flux passes through the intermediate portion 51*b*, the outer peripheral portion 40*b*, the bottom cover layer 19*b*, the core portion 30*b*, and the intermediate portion 51*b*, and returns to the intermediate portion 51*a* and the core portion 30*a* of the coil unit 1*a*. Since the magnetic permeabilities of the intermediate portion 51*a* and the intermediate portion 51*b* in the direction perpendicular to the coil axis CL are smaller than those of the outer peripheral portion 40*a* and the outer peripheral portion 40*b* in the direction parallel to the coil axis CL, the magnetic flux passing through the outer peripheral portion 40*a* runs in a path that extends through the outer peripheral portion 40*a* in parallel to the coil axis CL and enters the outer peripheral portion 40*b*, not in a path that extends through the intermediate portion 51*a* or the intermediate portion 51*b* and returns to the core portion 30*a*. Therefore, there is less leakage magnetic flux occurring between the coil conductor 25*a* and the coil conductor 25*b* in the coil component 101. Although the intermediate portion 51*a* and the intermediate portion 51*b* are interposed in the closed magnetic path, the easy magnetization direction of the intermediate portion 51*a* and the intermediate portion 51*b* is the same as the direction of the magnetic flux, and therefore, the effective permeability of the coil component 101 is not degraded by the intermediate portion 51*a* and the intermediate portion 51*b*.

Figure 6:
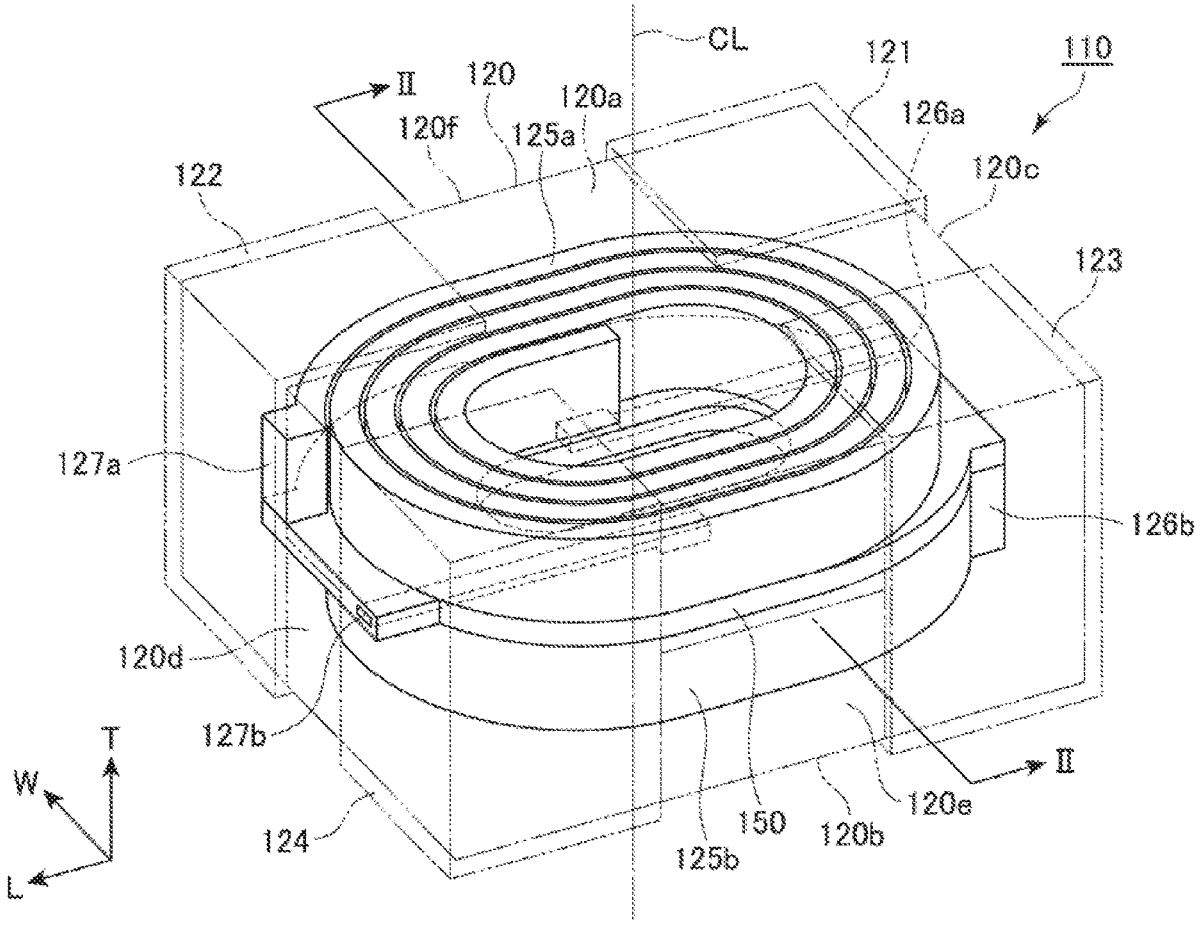
FIG. 6 is a perspective view of the coil component according to still another embodiment of the present invention.

Next, with reference to FIG. 6, a description is given of a coil component 110 according to still another embodiment of the present invention. The coil component 110 is different from the coil component 1 in that in coil component 110, the coil is formed as a planar coil by a thin film process, whereas in the coil component 1, the coil is formed in a spiral shape by the lamination process.

As shown, the coil component 110 according to one embodiment of the present invention includes an insulator body 120, an insulating substrate 150, a coil conductor 125*a* formed on the top surface of the insulating substrate 150, a coil conductor 125*b* formed on the bottom surface of the insulating substrate 150, an external electrode 121 electrically connected to one end of the coil conductor 125*a*, an external electrode 122 electrically connected to the other end of the coil conductor 125*a*, an external electrode 123 electrically connected to one end of the coil conductor 125*b*, and an external electrode 124 electrically connected to the other end of the coil conductor 125*b*.

The insulating substrate 150 is formed of an anisotropic magnetic material having an easy magnetization direction parallel to the coil axis CL. The anisotropic magnetic material is, for example, a composite magnetic material containing a resin and flat-shaped filler particles. The resin is a thermosetting resin having an excellent insulating quality. More specifically, the resin contained in the insulating substrate 150 may be the same as that contained in the insulating layers 20*a*1 to 20*a*7, and detailed description thereof will be omitted.

The filler particles contained in the insulating substrate 150 are contained in the resin so as to assume such a position that the longest axes thereof are parallel to the coil axis CL and the short axes thereof are perpendicular to the coil axis CL. With the filler particles assuming such a position, the magnetic permeability of the insulating substrate 150 in the direction parallel to the coil axis CL is larger than that in the direction perpendicular to the coil axis CL. Thus, the insulating substrate 150 has an easy magnetization direction parallel to the coil axis CL and a hard magnetization direction perpendicular to the coil axis CL. To ensure that the insulating substrate 150 has an easy magnetization direction parallel to the coil axis CL and a hard magnetization direction perpendicular to the coil axis CL, it is not necessary that all the filler particles contained in the insulating substrate 150 have the longest axes thereof oriented accurately perpendicular to the axis T. The filler particles contained in the insulating substrate 150 may be the same as those contained in the insulating layers 20*a*1 to 20*a*7, and detailed description thereof will be omitted.

In one embodiment of the present invention, the insulating substrate 150 has a larger resistance value than the insulator body 120. Thus, even when the insulating substrate 150 has a small thickness, electric insulation between the coil conductor 125*a* and the coil conductor 125*b* can be ensured.

The coil conductor 125*a* is formed in a pattern on the top surface of the insulating substrate 150. In the embodiment shown, the coil conductor 125*a* includes a turning portion having a plurality of turns around the coil axis CL.

Likewise, the coil conductor 125*b* is formed in a pattern on the bottom surface of the insulating substrate 150. In the embodiment shown, the coil conductor 125*b* includes a turning portion having a plurality of turns around the coil axis CL. In one embodiment of the present invention, the top surface of the turning portion of the coil conductor 125*b* is opposed to the bottom surface of the turning portion of the coil conductor 125*a*.

The coil conductor 125*a* has a lead conductor 126*a* on one end thereof and a lead conductor 127*a* on the other end. The coil conductor 125*a* is electrically connected to the external electrode 121 via the lead conductor 126*a* and is electrically connected to the external electrode 122 via the lead conductor 127*a*. Likewise, the coil conductor 125*b* has a lead conductor 126*b* on one end thereof and a lead conductor 127*b* on the other end. The coil conductor 125*b* is electrically connected to the external electrode 123 via the lead conductor 126*b* and is electrically connected to the external electrode 124 via the lead conductor 127*b*.

The coil conductor 125*a* and the coil conductor 125*b* are formed by forming a patterned resist on the surface of the insulating substrate 150 and filling a conductive metal into an opening in the resist by plating.

In one embodiment of the present invention, the insulator body 120 has a first principal surface 120*a*, a second principal surface 120*b*, a first end surface 120*c*, a second end surface 120*d*, a first side surface 120*e*, and a second side surface 120*f*. The outer surface of the insulator body 120 is defined by these six surfaces.

In one embodiment of the present invention, the insulator body 120 is made of a resin containing a large number of filler particles dispersed therein. In another embodiment of the present invention, the insulator body 120 is made of a resin containing no filler particles. In one embodiment of the present invention, the resin contained in the insulator body 120 is a thermosetting resin having an excellent insulating quality.

Examples of a thermosetting resin used to form the insulator body 120 include benzocyclobutene (BCB), an epoxy resin, a phenolic resin, an unsaturated polyester resin, a vinyl ester resin, a polyimide resin (PI), a polyphenylene ether (oxide) resin (PPO), a bismaleimide-triazine cyanate ester resin, a fumarate resin, a polybutadiene resin, and a polyvinyl benzyl ether resin.

In one embodiment of the present invention, the filler particles contained in the insulator body 120 may be the same as those contained in the insulating layers 20*a*1 to 20*a*7.

The external electrode 121 and the external electrode 123 are provided on the first end surface 120*c* of the insulator body 120. The external electrode 122 and the external electrode 124 are provided on the second end surface 120*d* of the insulator body 120. As shown, these external electrodes extend onto the top surface 120*a* and the bottom surface 120*b* of the insulator body 120.

Next, a description is given of an example of a production method of the coil component 110. The coil component 110 can be produced by, for example, a thin film process. First, the insulating substrate 150 is prepared. Next, a photoresist is applied to the top surface and the bottom surface of the insulating substrate 150. Next, the conductive pattern of the coil conductor 125*a* is transferred onto the top surface of the insulating substrate 150 by exposure using a photomask, and development is performed. As a result, a resist having an opening pattern for forming the coil conductor 125*a* is formed on the top surface of the insulating substrate 150. Likewise, a resist having an opening pattern for forming the coil conductor 125*b* is formed on the bottom surface of the insulating substrate 150. Next, a conductive metal is filled into each of the opening patterns by plating. Next, the resists are removed by etching to form the coil conductor 125*a* on the top surface of the insulating substrate 150 and form the coil conductor 125*b* on the bottom surface of the insulating substrate 150.

Next, the insulator body 120 is formed on both surfaces of the insulating substrate 150 having the coil conductor 125*a* and the coil conductor 125*b* formed thereon. The insulator body 120 is formed by lamination, pressing, or the like using a resin containing a filler.

Next, the body laminate is segmented to a desired size by using a cutter such as a dicing machine or a laser processing machine to obtain a laminate having a size of a unit component corresponding to the insulator body 120. Next, the external electrodes 121 to 124 are formed on the segmented laminate. Each of the external electrodes is formed by applying a conductive paste on the surface of the insulator body 120 to form a base electrode and forming a plating layer on the surface of the base electrode. The plating layer is constituted by, for example, two layers including a nickel plating layer containing nickel and a tin plating layer containing tin.

The coil component 110 according to one embodiment of the present invention is obtained through the above steps. The above-described method for producing the coil component 110 is merely one example, which does not limit methods for producing the coil component 110.

Figure 7:
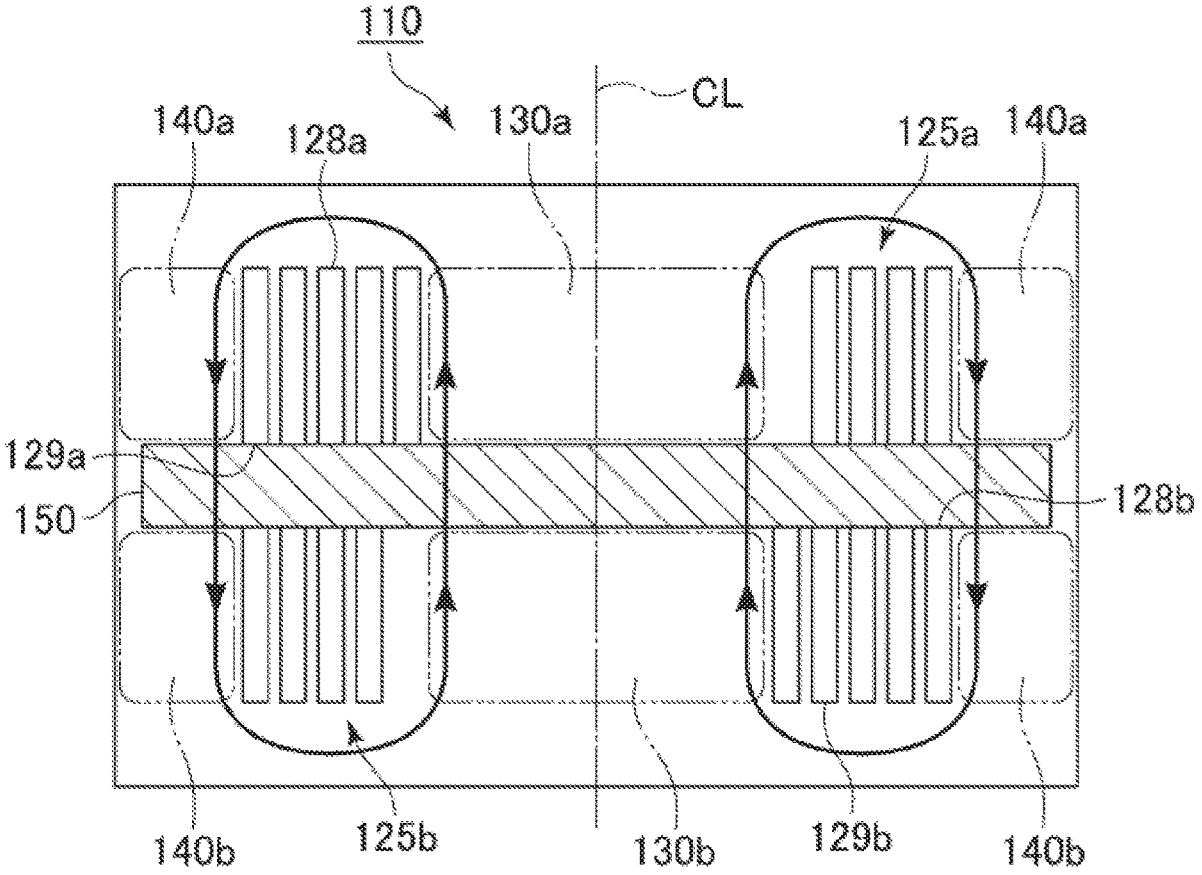
FIG. 7 schematically shows a cross section of the coil element of FIG. 6 cut along the line II-II.

Next, a description is given of magnetic flux generated in the coil component 110 with reference to FIG. 7. FIG. 7 schematically shows a cross section of the coil component of FIG. 6 cut along the line II-II. In FIG. 7, the magnetic flux (the lines of magnetic force) generated from the coil conductor is represented by arrows. In FIG. 7, the external electrodes are omitted for convenience of description.

As shown, the coil conductor 125*a* has a top surface 128*a* and a bottom surface 129*a*, the top surface 128*a* constituting one end of the coil conductor 125*a* in the direction of the coil axis CL, the bottom surface 129*a* constituting the other end of the coil conductor 125*a* in the direction of the coil axis CL. The coil conductor 125*b* has a top surface 128*b* and a bottom surface 129*b*, the top surface 128*b* constituting one end of the coil conductor 125*b* in the direction of the coil axis CL, the bottom surface 129*b* constituting the other end of the coil conductor 125*b* in the direction of the coil axis CL. As shown, the coil conductor 125*a* is disposed such that the bottom surface 129*a* thereof is opposed to the top surface 128*b* of the coil conductor 125*b*.

The insulator body 120 includes a core portion 130*a* positioned inside the coil conductor 125*a*, an outer peripheral portion 140*a* positioned outside the coil conductor 125*a*, a core portion 130*b* positioned inside the coil conductor 125*b*, and an outer peripheral portion 140*b* positioned outside the coil conductor 125*b*.

In the coil component 110, the magnetic flux generated from the electric current flowing through the coil conductor 125*a* runs in a closed magnetic path shown by the arrows in FIG. 7 that extends through the core portion 130*a*, the outer peripheral portion 140*a*, the insulating substrate 150 (the portion positioned outside the coil conductor 125*a* and the coil conductor 125*b*), the outer peripheral portion 140*b*, the core portion 130*b*, and the insulating substrate 150 (the portion positioned inside the coil conductor 125*a* and the coil conductor 125*b*) and returns to the core portion 130*a*. Since the magnetic permeability of the insulating substrate 150 in the direction perpendicular to the coil axis CL is smaller than those of the outer peripheral portion 140*a*, the outer peripheral portion 140*b*, and the insulating substrate 150 in the direction parallel to the coil axis CL, the magnetic flux passing through the outer peripheral portion 140*a* runs in a path that extends through the insulating substrate 150 in parallel to the coil axis CL and enters the outer peripheral portion 140*b*, not in a path that extends through the insulating substrate 150 in the direction perpendicular to the coil axis CL and returns to the core portion 130*a*. The magnetic flux generated from the electric current flowing through the coil conductor 125*b* also runs in a similar closed magnetic path. Therefore, there is less leakage magnetic flux occurring between the coil conductor 125*a* and the coil conductor 125*b* in the coil component 110. Accordingly, the coil component 110 also achieves an improved coupling coefficient as compared to conventional magnetic coupling coil components liable to leakage magnetic flux between coil conductors.

The coil component 110, which is formed by the thin film process, is more susceptible to downsizing than assembled coupled inductors.

The dimensions, materials, and arrangements of the various constituents described in this specification are not limited to those explicitly described for the embodiments, and the various constituents can be modified to have any dimensions, materials, and arrangements within the scope of the present invention. The constituents other than those explicitly described herein can be added to the described embodiments; and part of the constituents described for the embodiments can be omitted.

What is claimed is:

1. A coil component, comprising: an insulator body;

a first coil conductor embedded in the insulator body and wound around a coil axis; and a second coil conductor embedded in the insulator body and wound around the coil axis, the second coil conductor being insulated from the first coil conductor in the insulator body, wherein a first coil surface of the first coil conductor is opposed to a second coil surface of the second coil conductor, the insulator body includes:

an intermediate portion disposed between the first coil surface and the second coil surface;

a core portion disposed inside the first coil conductor and the second coil conductor; and an outer peripheral portion disposed outside the first coil conductor and the second coil conductor, and a magnetic permeability of the intermediate portion in a direction perpendicular to the coil axis is smaller than those of the core portion and the outer peripheral portion in a direction parallel to the coil axis.

2. The coil component of claim 1, wherein the intermediate portion is made of a non-magnetic material.

3. The coil component of claim 1, wherein the intermediate portion is made of an anisotropic magnetic material having an easy magnetization direction parallel to the coil axis.

4. The coil component of claim 1, wherein the intermediate portion has a larger resistance value than the core portion.

5. The coil component of claim 1, wherein the intermediate portion has a larger resistance value than the outer peripheral portion.

6. The coil component of claim 1, wherein the core portion includes a first core portion disposed inside the first coil conductor and a second core portion disposed inside the second coil conductor, and the outer peripheral portion includes a first outer peripheral portion disposed outside the first coil conductor and a second outer peripheral portion disposed outside the second coil conductor.

7. The coil component of claim 1, further comprising:

a first external electrode connected to one end of the first coil conductor;

a second external electrode connected to the other end of the first coil conductor;

a third external electrode connected to one end of the second coil conductor; and a fourth external electrode connected to the other end of the second coil conductor.

8. The coil component of claim 6, wherein the intermediate portion intervenes between the first core portion and the second core portion as well as between the first outer peripheral portion and the second outer peripheral portion.

9. A coil component, comprising: an insulator body;

an insulating substrate embedded in the insulator body;

a first coil conductor formed on one surface of the insulating substrate and wound around a coil axis; and a second coil conductor formed on another surface of the insulating substrate and wound around the coil axis, the second coil conductor being insulated from the first coil conductor in the insulator body, wherein a magnetic permeability of the insulating substrate in a direction perpendicular to the coil axis is smaller than that in a direction parallel to the coil axis.

10. The coil component of claim 9, wherein the insulating substrate is made of a non-magnetic material.

11. The coil component of claim 9, wherein the insulating substrate is made of an anisotropic magnetic material having an easy magnetization direction parallel to the coil axis.

12. The coil component of claim 9, wherein the insulating substrate has a larger resistance value than the insulator body.

13. The coil component of claim 9, further comprising:

a first external electrode connected to one end of the first coil conductor;

a second external electrode connected to the other end of the first coil conductor;

a third external electrode connected to one end of the second coil conductor; and a fourth external electrode connected to the other end of the second coil conductor.

14. The coil component of claim 9, wherein the insulator body includes a first core portion disposed inside the first coil conductor and a second core portion disposed inside the second coil conductor;

wherein the insulator body further includes a first outer peripheral portion disposed outside the first coil conductor and a second outer peripheral portion disposed outside the second coil conductor, and wherein the insulating substrate intervenes between the first core portion and the second core portion as well as between the first outer peripheral portion and the second outer peripheral portion.

* * * * *